US008137752B2

(12) United States Patent
Lee

(10) Patent No.: US 8,137,752 B2
(45) Date of Patent: Mar. 20, 2012

(54) METHOD AND APPARATUS FOR THE TREATMENT OF INDIVIDUAL FILAMENTS OF A MULTIFILAMENT YARN

(75) Inventor: Jar-Wha Lee, Columbus, OH (US)

(73) Assignee: Syscom Advanced Materials, Inc., Columbus, OH (US)

( * ) Notice: Subject to any disclaimer, the term of this patent is extended or adjusted under 35 U.S.C. 154(b) by 874 days.

(21) Appl. No.: 12/167,650

(22) Filed: Jul. 3, 2008

(65) Prior Publication Data

US 2008/0280045 A1 Nov. 13, 2008

Related U.S. Application Data

(63) Continuation-in-part of application No. 10/731,863, filed on Dec. 8, 2003, now abandoned.

(51) Int. Cl.
*B05D 3/04* (2006.01)
*B05D 1/18* (2006.01)

(52) U.S. Cl. ..... 427/304; 427/434.2; 427/434.5; 427/434.6; 427/443.1

(58) Field of Classification Search ..... 427/304, 427/305, 306, 434.6, 175, 434.5, 443.1, 601, 427/99.5, 434.2, 434.7, 435, 436, 437; 118/429, 118/405

See application file for complete search history.

(56) References Cited

U.S. PATENT DOCUMENTS

| | | | |
|---|---|---|---|
| 3,308,042 | A | 3/1967 | Lozano et al. |
| 3,460,978 | A | 8/1969 | Clayton et al. |
| 3,674,550 | A | 7/1972 | Mallory |
| 3,708,405 | A | 1/1973 | Kamata |
| 3,870,551 | A | 3/1975 | Iwami et al. |
| 3,896,010 | A | 7/1975 | Vetter |
| 3,919,069 | A | 11/1975 | Ascher |
| 3,962,494 | A | 6/1976 | Nuzzi |
| 3,967,010 | A | 6/1976 | Maekawa |
| 4,008,343 | A | 2/1977 | Cohen et al. |
| 4,086,374 | A | 4/1978 | Suzuki et al. |
| 4,169,426 | A | 10/1979 | Kornmann |

(Continued)

FOREIGN PATENT DOCUMENTS

EP 0269850 A1 6/1988

(Continued)

OTHER PUBLICATIONS

USPTO, Requirement for Restriction/Election for U.S. Appl. No. 10/731,863, mailed Apr. 10, 2007, 5 pages.

(Continued)

*Primary Examiner* — Dah-Wei Yuan
*Assistant Examiner* — Nga Leung V Law

(57) ABSTRACT

A method and apparatus for treating the surfaces of individual filaments in multifilament yarn. The method includes the steps of immersing the yarn into a liquid treatment solution and coating all exposed surface areas of each individual filament with the treatment solution, disrupting the orientation of the individual filaments and coating all newly exposed surface areas of each individual filament with the treatment solution, and repeating the previous steps until a predetermined treatment level is achieved. A filament orientation disruption assembly may include at least one roller having a roller profile such that for a given transverse section of the roller, a roller surface perimeter has a plurality of points located a plurality of distinct distances from a central axis of the roller, i.e., a non-cylindrical roller. The method is particularly effective in plating highly anisotropic uniaxially oriented polymer fibers, such as PBO.

15 Claims, 9 Drawing Sheets

U.S. PATENT DOCUMENTS

| | | | | |
|---|---|---|---|---|
| 4,214,961 | A | 7/1980 | Anthony | |
| 4,388,370 | A | 6/1983 | Ellis | |
| 4,395,320 | A | 7/1983 | Kasashima et al. | |
| 4,609,437 | A | 9/1986 | Kruishoop et al. | |
| 4,624,751 | A | 11/1986 | Morin et al. | |
| 4,911,797 | A | 3/1990 | Hoebel | |
| 4,959,129 | A | 9/1990 | Fuchs et al. | |
| 5,021,258 | A | 6/1991 | McGarry | |
| 5,230,927 | A * | 7/1993 | Nishizawa et al. | 427/306 |
| 5,244,748 | A | 9/1993 | Weeks | |
| 5,302,415 | A | 4/1994 | Gabara et al. | |
| 5,399,382 | A | 3/1995 | Burch et al. | |
| 5,399,425 | A | 3/1995 | Burch | |
| 5,422,142 | A | 6/1995 | Hsu | |
| 5,453,299 | A | 9/1995 | Hsu | |
| 5,528,799 | A | 6/1996 | Bach et al. | |
| 5,549,972 | A | 8/1996 | Hsu et al. | |
| 5,792,713 | A | 8/1998 | Scari | |
| 5,935,706 | A | 8/1999 | Hoover et al. | |
| 6,045,680 | A | 4/2000 | Cawston et al. | |
| 6,099,624 | A | 8/2000 | Martyak | |
| 6,187,378 | B1 | 2/2001 | Doncsecz | |
| 6,199,266 | B1 | 3/2001 | Meserve | |
| 6,228,922 | B1 | 5/2001 | Wang et al. | |
| 6,281,157 | B1 | 8/2001 | Tangi et al. | |
| 6,726,964 | B1 | 4/2004 | Thompson | |
| 7,923,390 | B2 | 4/2011 | Burke | |
| 2003/0129900 | A1 | 7/2003 | Chiou | |
| 2003/0224111 | A1 | 12/2003 | Suganuma et al. | |
| 2005/0089639 | A1 | 4/2005 | Suganuma et al. | |
| 2006/0057415 | A1 | 3/2006 | Watson | |
| 2007/0031621 | A1 | 2/2007 | Morimoto | |
| 2007/0089899 | A1 | 4/2007 | Roberts | |
| 2007/0131164 | A1 * | 6/2007 | Park et al. | 118/429 |

FOREIGN PATENT DOCUMENTS

| | | |
|---|---|---|
| SU | 703150 B | 12/1979 |

OTHER PUBLICATIONS

USPTO, Non-Final Office Action for U.S. Appl. No. 10/731,863, mailed Jun. 4, 2007, 22 pages.

USPTO, Final Office Action for U.S. Appl. No. 10/731,863, mailed Jan. 8, 2008, 39 pages.

Office Action—Re-exam 95/001,721, mailed Dec. 13, 2011.

* cited by examiner

METHOD AND APPARATUS FOR THE TREATMENT OF INDIVIDUAL FILAMENTS OF A MULTIFILAMENT YARN

CROSS-REFERENCE TO RELATED DOCUMENTS

This application is a continuation-in-part of a previous application filed in the United States Patent and Trademark Office on Dec. 8, 2003, titled "Method and Apparatus for the Treatment of Individual Filaments of a Multifilament Yarn," and given Ser. No. 10/731,863 now abandoned, all of which is incorporated here by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to the field of multifilament yarns, in particular, to a method and apparatus for treating the surfaces of the individual filaments with treatment solutions.

BACKGROUND OF THE INVENTION

Those in the textile industry have long recognized the value in treating the entire surface area of each individual filament in a multifilament yarn. The industry has unsuccessfully tried to develop methods and apparatus to overcome the issues surrounding such surface treatment. In fact, many multifilament applications have dealt with the issue simply by treating the individual filament surfaces prior to creating the multifilament yarn; however, this individual surface treatment is not economically practical in most applications.

In the past, the textile industry has generally dealt with treating the surface of individual filaments of a multifilament yarn by submerging the yarn in a tank of treatment solution while the yarn is under no tension, or only enough tension to gradually move the yarn through the tank. Using this method, the yarn was left in the tank for an extended period of time to allow the treatment solution to penetrate past the outermost filaments and wet the innermost fibers.

The traditional method of treating multifilament yarns has many drawbacks. The most apparent drawback is that the method can be extremely slow as the yarn must be submerged in the treatment tank for a long period of time and cannot travel at any appreciable speed through the tank. Additionally, the extended exposure time required to treat the innermost filaments of the yarn subjects the outermost filaments to possible overexposure. For instance, it is often desirable to clean and etch the outer surfaces of the individual filaments of the multifilament yarn with an acidic solution. Using traditional treatment methods the outermost filaments may be subjected to the acidic solution significantly longer than the innermost filaments resulting in non-uniform etching and reduced filament strength.

Another significant drawback of this method is that surfactants are generally required to lower the surface tension of the treatment solution, and reduce the interfacial tension between the treatment solution and the filaments, thereby promoting wetting of the filaments. Surfactants introduce additional costs and difficulties in the surface treatment process. Yet a further drawback is that the yarn can become tangled in the treatment solution because it has to essentially float through the solution under little, or no, tension. This free floating aspect of the process further limits the processing speed in that additional measures that may improve the surface coating of the filaments, such as agitation of the solution and the yarn, cannot be implemented due to the increased likelihood of yarn entanglement.

The art has needed an improved method of treating the surfaces of the individual filaments of multifilament yarns that increases the processing speed, reduces reliance on surfactants, and provides increased uniformity of the surface treatment of inner filaments and outer filaments of the multifilament yarn. The method and apparatus of the present invention provides these desired qualities and significantly improves the state of the art of surface treatment of filament surfaces in multifilament yarns. With these capabilities taken into consideration, the instant invention addresses many of the shortcomings of the prior art and offers significant benefits heretofore unavailable.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

In an exemplary configuration, the method of treating the surfaces of individual filaments in a multifilament yarn of the present invention includes the steps of immersing the yarn into a liquid treatment solution and coating all exposed surface areas of each individual filament with the treatment solution, disrupting the orientation of the individual filaments and coating all newly exposed surface areas of each individual filament with the treatment solution, and repeating the previous steps until a predetermined treatment level is achieved, and then withdrawing the yarn from the treatment solution.

The general method begins with the yarn entering the treatment solution contained in a solution reservoir and passing through at least one filament orientation disruption assembly whereby the orientation of individual filaments is changed. This change of orientation exposes some previously unexposed areas of the individual filaments to the treatment solution. The force necessary to disrupt the orientation of the filaments is very small and is easily accomplished by simply changing the direction of travel of the yarn about a roller; however, other methods are contemplated herein. Not only does this method benefit from the exposure of previously unexposed surface areas to the treatment solution, but there is also frictional contact among the individual filaments that is desirable in a number of instances, as will be disclosed further later in this section. During the disruption of orientation of the filaments, they not only translate with respect to one another but may also rotate with respect to one another, and such motion may be controlled in part by the design of the filament orientation disruption assembly.

The disruption of the orientation of the filaments of this invention may be repetitively applied, and applied in a number of manners and orientations, to ensure that substantially all surface areas of the individual filaments are contacted by the treatment solution. Further, this methodology greatly reduces the amount of time that the yarn must be immersed in the treatment solution, thereby reducing the likelihood that exterior filaments are overexposed to the treatment solution. This method has proven to be so effective that the use of surfactants has been eliminated with most treatment solutions. Traditional multifilament treatment methods have generally relied upon the use of surfactants to lower the surface tension of the treatment solution, and reduce the interfacial tension between the treatment solution and the filaments, thereby promoting wetting of the filaments. Elimination of surfactants significantly reduces treatment costs and simplifies the treatment process. Additionally, the forced orientation disruption of the filaments permits the process to introduce greater amounts of tension on the yarn which permits increased travel speed and reduced processing time.

The present method permits the introduction of a step wherein the yarn and the treatment solution are agitated to increase the orientation disruption of the individual filaments and increase the treatment efficiency. The agitation may be introduced in any number of other ways including, but not limited to, ultrasonically, mechanically, chemically, electromechanically, acoustically, and electromagnetically.

Another embodiment of the present method incorporates the steps of repeatedly changing the direction of travel of yarn in, or through, the treatment solution. By repeatedly changing the direction of travel of the yarn, the actual volume of treatment solution is dramatically reduced and the physical size of the treatment reservoir may be greatly reduced. This embodiment also benefits from the ability to use orientation disruption assemblies to facilitate the changes in direction.

The apparatus of the present invention includes a treatment solution reservoir, containing a predetermined amount of liquid treatment solution and a yarn transfer system configured to feed at least one yarn through the reservoir, having at least one filament orientation disruption assembly configured to guide the yarn through a portion of the reservoir and disrupt the orientation of the individual filaments, thereby exposing previously unexposed surface areas of each individual filament to the treatment solution. The treatment solution reservoir may be configured simply as a holding tank containing the treatment solution into which the yarn is fed. The at least one filament orientation disruption assembly may be located within the reservoir, immersed in the treatment solution, or it may be external to the reservoir, or a hybrid thereof.

Alternatively, the apparatus may be configured to minimize the physical space required. In this particular embodiment, the apparatus is formed with an entry weir and an exit weir through which the yarn and the treatment solution may pass. The treatment solution is maintained at a solution level above that of the weirs such that the treatment solution flows from the reservoir through the weirs. One particular embodiment includes a first filament orientation disruption assembly and a second filament orientation disruption assembly between which the yarn may repeatedly traverse. The filament orientation disruption assemblies may be as simple as rollers located external to the reservoir, yet in close proximity to the weirs. The rollers may be configured to rotate as the yarn turns about them and may guide the yarn through the weirs and the reservoir while disrupting the orientation of the individual filaments and thereby exposing previously unexposed surface areas of each individual filament to the treatment solution. One with skill in the art will appreciate that the filament orientation disruption assemblies may incorporate any number of material handling assemblies that would disrupt the orientation of the individual filaments.

In one particular embodiment, it may be desirable that the at least one filament orientation disruption assembly further include at least one roller having a roller profile such that for a given transverse section of the roller, a roller surface perimeter has a plurality of points located a plurality of distinct distances from a central axis of the roller. Such as non-cylindrical roller has advantages that will be discussed at length below.

The apparatus may further include a collection and filtration system having a collection basin, configured to collect the treatment solution as it exits the weirs, a filtration assembly to filter the treatment solution collected in the collection basin, and a pump to transfer the filtered treatment solution back into the treatment solution reservoir. The filtered treatment solution may enter the treatment solution reservoir at such locations, and in such a fashion, as to impart desirable flow patterns in the treatment solution reservoir. Such desirable flow patterns may reduce the likelihood of contamination in the treatment solution.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

The method and apparatus for treating the surfaces of individual filaments in a multifilament yarn of the instant invention enables a significant advance in the state of the art. The preferred embodiments of the method and apparatus accomplish this by new and novel arrangements of elements and methods that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

One exemplary embodiment of the method of treating the surfaces of individual filaments in a multifilament yarn Y of the present invention includes the steps of immersing the yarn Y into a liquid treatment solution S and coating all exposed surface areas of each individual filament F with the treatment solution S, disrupting the orientation of the individual filaments F and coating all newly exposed surface areas of each individual filament F with the treatment solution S, and repeating the previous steps until a predetermined treatment level is achieved, and then withdrawing the yarn Y from the treatment solution S. As one with skill in the art will recognize, the desired predetermined treatment level will vary with the type of treatment being applied to the surface of the individual filaments F, as well as other variables that will be later disclosed herein. For instance, the predetermined treatment level required when dyeing a white yarn black may be greatly different than the predetermined treatment level required when catalyzing a high strength aromatic-heterocyclic rigid-rod polymer. The method and apparatus of the present invention advances the art of treating the surfaces of such varied multifilament yarns equally as well.

Figure 1:
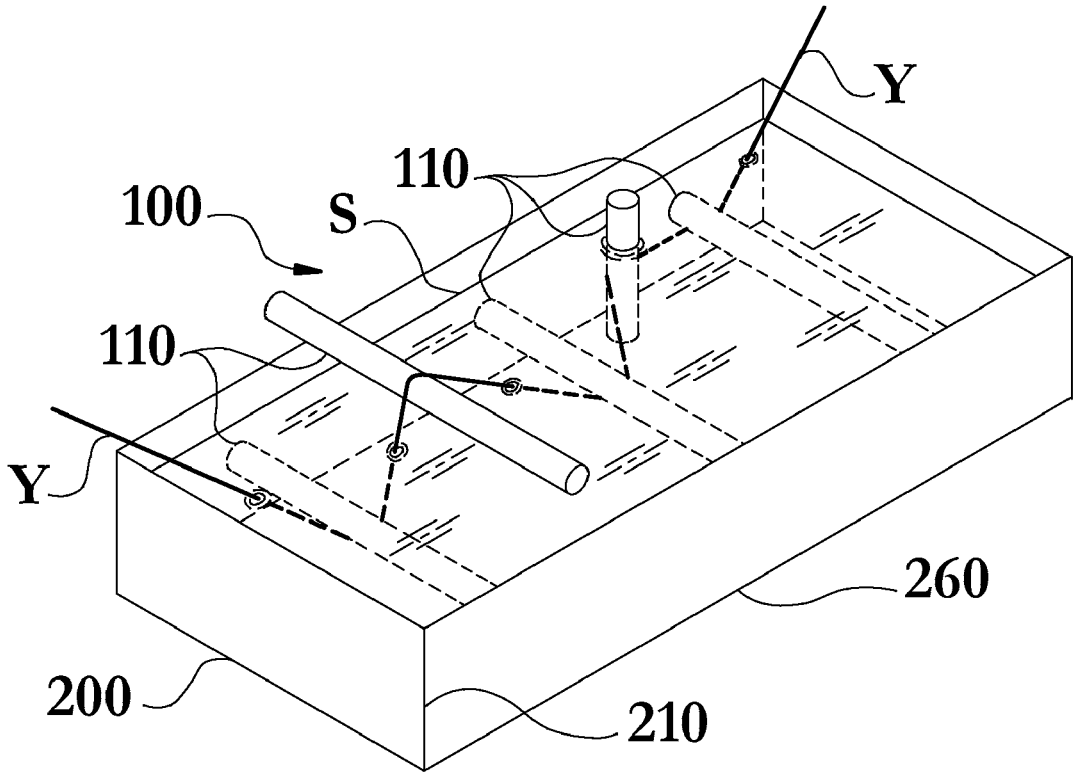
FIG. 1 illustrates the method of the present invention in elevated perspective view, not to scale.

The general method is illustrated in FIG. 1. Starting at the left of the figure, the yarn Y enters the treatment solution S contained in a solution reservoir 200 and passes through at least one filament orientation disruption assembly 110 whereby the orientation of individual filaments F is changed, thereby exposing some previously unexposed areas of the individual filaments F to the treatment solution S. It is important to note, and as will be illustrated later herein, that the at least one filament orientation disruption assembly 110 may be immersed in the treatment solution S, located completely external to the treatment solution S and reservoir 200, or some combination of both, depending on the treatment being performed.

Figure 3A:
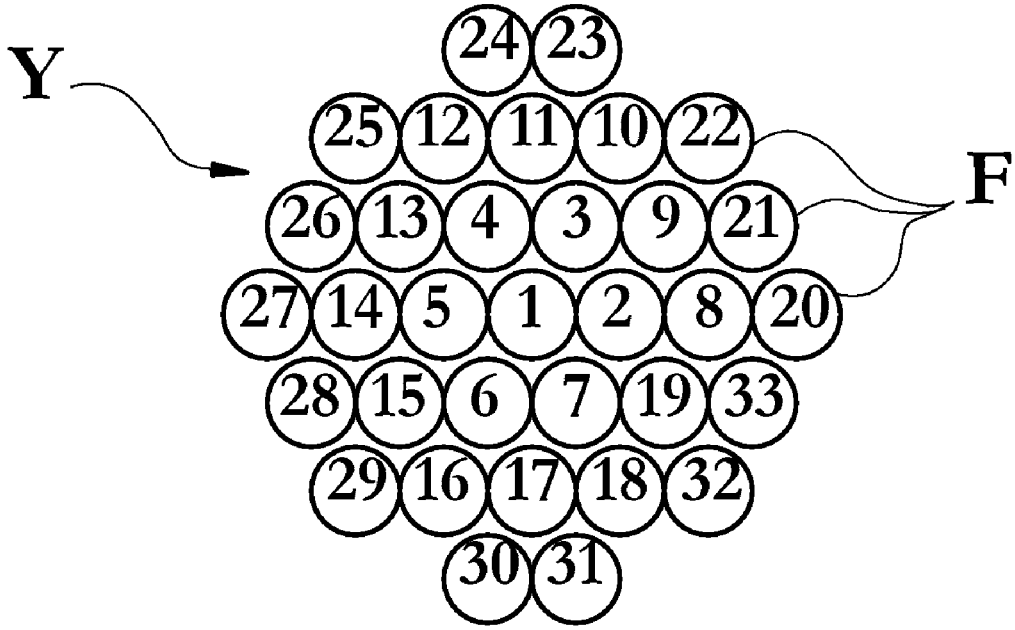
FIG. 3*a* illustrates a multifilament yarn, in cross sectional view, not to scale.
Figure 3B:
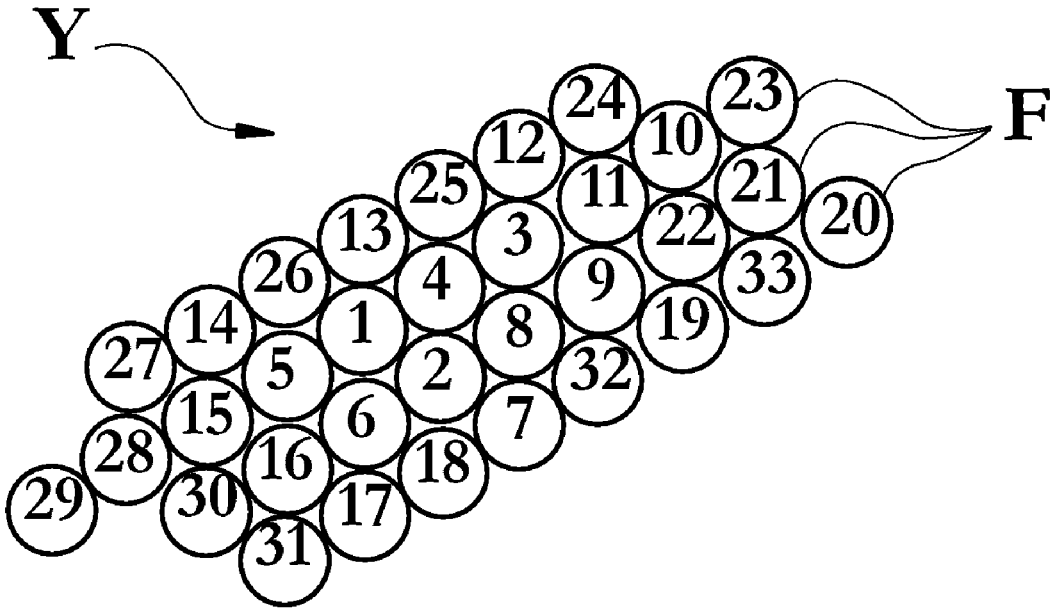
FIG. 3*b* illustrates the multifilament yarn of FIG. 3*a*, in cross sectional view, not to scale, after disruption of the orientation of the individual filaments.

The disruption of the orientation of the individual filaments F is illustrated in FIGS. 3*a* and 3*b*. For instance, FIG. 3*a* illustrates a 33 filament yarn Y with the filaments F in an initial orientation. One with skill in the art will appreciate that this 33 filament yarn Y is for illustrative purposes only and the discussion and principles described are applicable to yarns Y having hundreds of filaments F, or more, and yarn Y having filaments F with structural matrices different than that illustrated. FIG. 3*b* illustrates the yarn of FIG. 3*a* upon a disruption of the orientation of the individual filaments F thereby exposing previously unexposed areas of the filaments F. The disruption of the filament orientation illustrated in FIG. 3*b* is consistent with the exertion of a compressive force on the yarn Y at an angle of approximately 30 degrees from the horizontal. The compressive force necessary to disrupt the orientation is very small and is easily accomplished by simply changing the direction of travel of the yarn Y about a roller; however, other methods are contemplated herein. Not only does this method benefit from the exposure of previously unexposed surface areas to the treatment solution S, but there is also frictional contact among the individual filaments F that is desirable in a number of instances, as will be disclosed further in this section. It is important to note that during the disruption of the orientation of the filaments F, they not only translate with respect to one another but may also rotate with respect to one another, and that such motion may be controlled in part by the design of the filament orientation disruption assembly 110. Additionally, various embodiments of the filament orientation disruption assembly 110 will be disclosed later in this section.

One with skill in the art will appreciate that the disruption of the orientation of the filaments F of this invention may be repetitively applied, and applied in a number of manners and orientations, to ensure that substantially all surface areas of the individual filaments F are contacted by the treatment solution S, if so desired. Further, this methodology greatly reduces the amount of time that the yarn Y must be immersed in the treatment solution S, thereby reducing the likelihood that exterior filaments F are overexposed to the treatment solution S, as is often the case in etching and acidic cleaning operations. Such overexposure is common and the resultant excess etching may severely damage the mechanical integrity of overexposed filaments F.

This method has proven to be so effective at exposing the surface area of the individual filaments F to the treatment solution that the use of surfactants has been eliminated with most treatment solutions S. Traditional multifilament treatment methods have generally relied upon the use of surfactants to lower the surface tension of the treatment solution, and reduce the interfacial tension between the treatment solution and the filaments, thereby promoting wetting of the filaments. Elimination of surfactants significantly reduces treatment costs and simplifies the treatment process.

The method of the present invention allows the treatment process speed to be greatly improved. The forced orientation disruption of the filaments F permits the process to introduce greater amounts of tension on the yarn Y which permits increased travel speed and reduced processing time. The method may include the step of introducing a predetermined amount of tension to the yarn Y at any point in the process. Additionally, alternative embodiments may include tension controllers that continuously vary the tension according to the type of treatment solution S, to maintain specific travel rates at various stages in the method, or to vary the amount of exposure to the treatment solution S, just to name a few.

Figure 2:
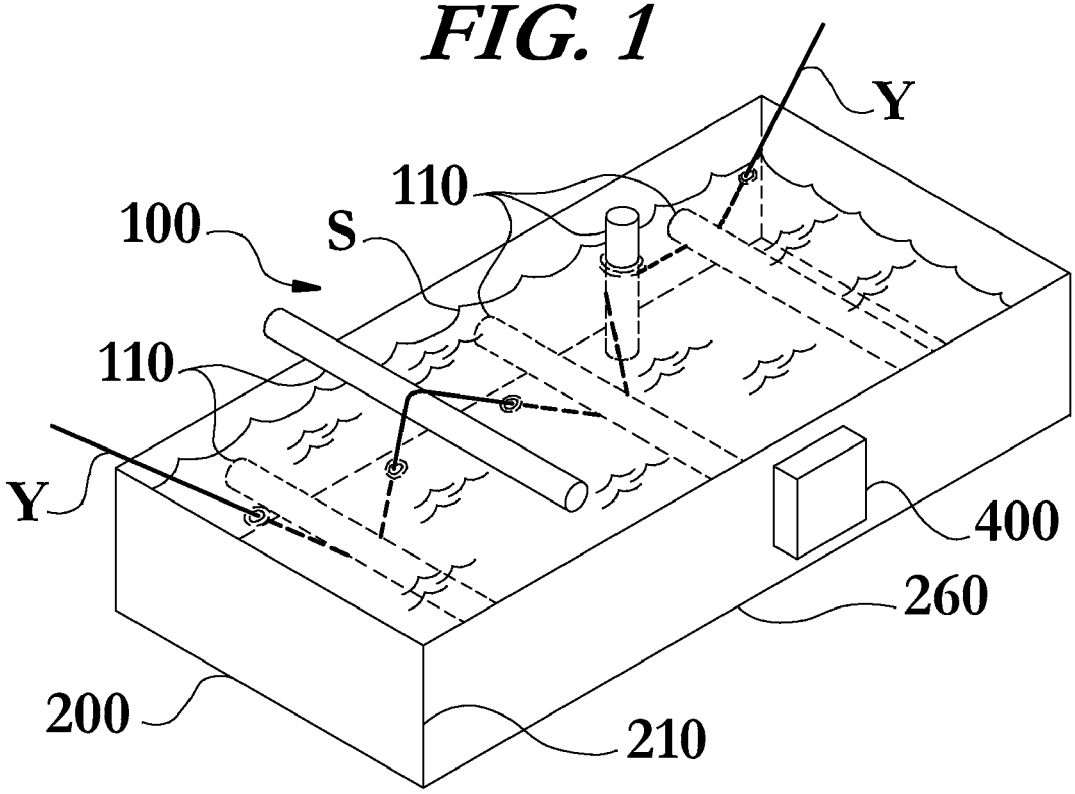
FIG. 2 illustrates the method of the present invention in elevated perspective view, not to scale.

Further, the present method provides the robustness necessary to further introduce the step of agitating the yarn Y and the treatment solution S to increase the orientation disruption of the individual filaments F and increase the treatment efficiency. In one embodiment the agitation is introduced ultrasonically to the treatment solution S and yarn Y, as seen in FIG. 2. One with skill in the art will appreciate that the agitation may be introduced in any number of other ways including, but not limited to, mechanically, chemically, electromechanically, acoustically, and electromagnetically.

Another embodiment of the present method incorporates a sequence that provides the additional benefit of only necessitating a very small operating space, unlike traditional multifilament yarn treatment methods. Since the present method performs effectively while the yarn Y is under some degree of tension, the method may incorporate the steps of repeatedly changing the direction of travel of yarn Y in, or through, the treatment solution S, as illustrated in one embodiment in FIG. 4, and in an alternative embodiment in FIG. 10. By repeatedly changing the direction of travel of the yarn Y, the actual volume of treatment solution S may be dramatically reduced, and therefore the physical size of the treatment reservoir 200 may be greatly reduced. This embodiment also benefits from the ability to use orientation disruption assemblies 110, 130 to facilitate the changes in direction. Therefore, multiple changes in direction may lead to a very small solution reservoir 200, may provide the required amount of contact time with the solution S under increased processing speed, and may permit the disruption of the orientation of the filaments F at each change in direction. One with skill in the art will recognize that given the characteristics of the yarn Y, the desired degree of surface contact and contact time, and the properties of the treatment solution S; the number of passes or changes in direction may be determined.

Figure 7:
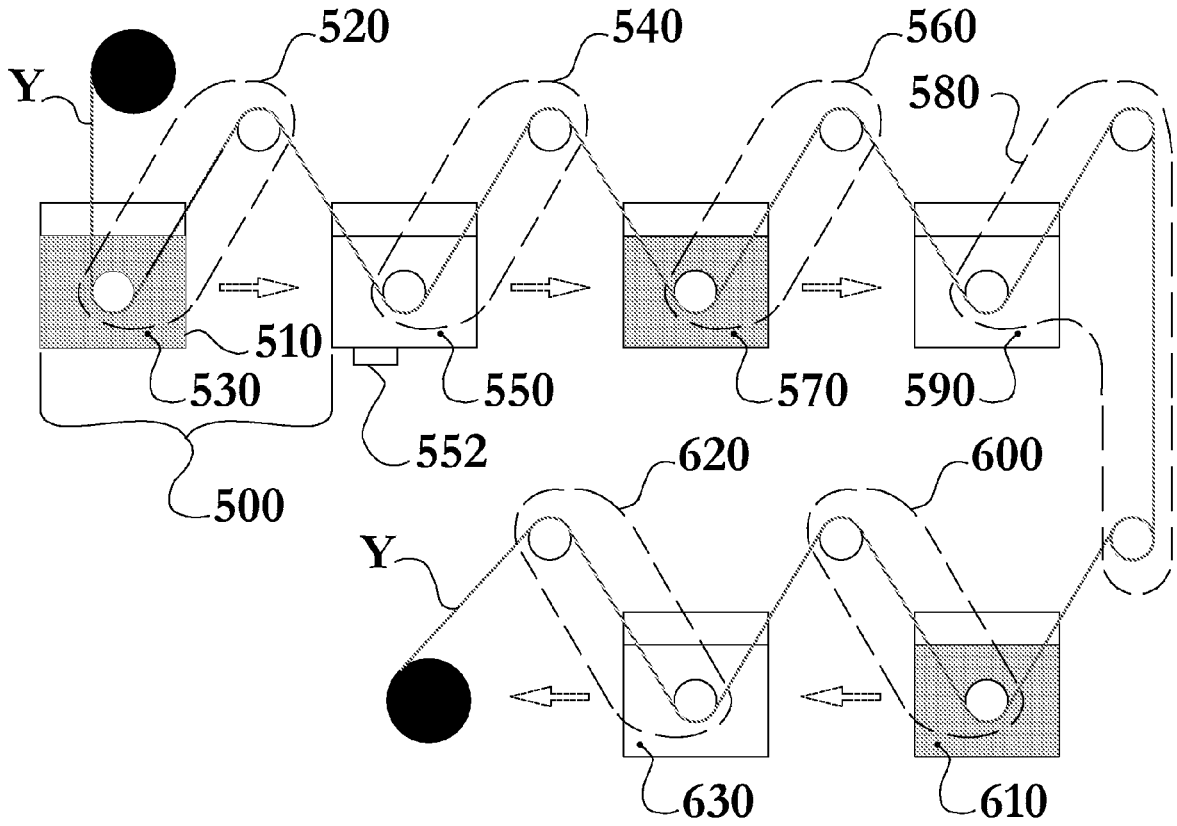
FIG. 7 illustrates a schematic of a method of an embodiment of the present invention.

Yet another embodiment of the method of the present invention is directed to electroless plating of nonmetallic filaments F of a multifilament yarn Y, illustrated in FIG. 7. This embodiment includes a plurality of processing cells 500, each having a treatment solution reservoir 510 containing a predetermined amount of treatment solution S specific to the particular stage of the plating process. The yarn Y begins the plating process in a first yarn transfer system 520 that guides the ingress and egress of the yarn Y from a first treatment solution reservoir comprising an acidic solution 530 and disrupts the orientation of the individual filaments F of the yarn Y to achieve a substantially uniform etching of the exterior surface of each individual filament F. Next, the yarn Y is transferred from the first yarn transfer system 520 to a second yarn transfer system 540 that guides the ingress and egress of the yarn Y from a second treatment solution reservoir comprising a bathing solution 550 and disrupts the orientation of the individual filaments F of the yarn Y to remove substantially all of the acidic solution 530 from each individual filament F. Thirdly, the yarn Y is transferred from the second yarn transfer system 540 to a third yarn transfer system 560 that guides the ingress and egress of the yarn Y from a third treatment solution reservoir comprising a catalyzing solution 570 and disrupts the orientation of the individual filaments F of the yarn Y to achieve substantially uniform absorption of a plurality of metal ions on each of the individual filaments F. Next, the yarn Y is transferred from the third yarn transfer system 560 to a fourth yarn transfer system 580 that guides the ingress and egress of the yarn Y from a fourth treatment solution reservoir comprising a reduction solution 590 and disrupts the orientation of the individual filaments F of the yarn Y to facilitate substantially uniform reduction of the plurality of metal ions on each individual filament F to form a substantially uniform coating of metal on each of the individual filaments F of the yarn Y. Lastly, the yarn Y is transferred from the fourth yarn transfer system 580 to a fifth yarn transfer system 600 that guides the ingress and egress of the yarn Y from a fifth treatment solution reservoir comprising an electroless bath 610 and disrupts the orientation of the individual filaments F of the yarn Y to facilitate a substantially uniform conductive undercoating on each of the individual filaments F of the yarn Y.

One with skill in the art will appreciate that additional processing cells 500 beyond a fifth treatment reservoir may easily be incorporated into the present method to include additional operations including, but not limited to, intermediary cleaning and treatment of the yarn Y, as well as finishing operations such as electroplating of the yarn Y. As such, the yarn Y may be transferred from the fifth yarn transfer system 600 to a sixth yarn transfer system 620 that guides the ingress and egress of the yarn Y from a sixth treatment solution reservoir comprising an electroplating bath solution 630 and disrupts the orientation of the individual filaments F of the yarn Y to facilitate a substantially uniform plating on each of the individual filaments F of the yarn Y. As previously disclosed, any of the treatment solutions reservoirs 510 may incorporate devices to introduce agitation, by means of an agitator 552, into the treatment solution and the yarn Y. Additionally, one with skill in the art will appreciate that the present method may include steps varying the amount of tension on the yarn Y in each processing cell 500.

In particular, such tension variation may be produced, in one particular embodiment, by passing the yarn Y around at least one filament orientation disruption assembly 110 further including at least one roller 112, 132 having a roller profile such that for a given transverse section of the roller 112, 132, a roller surface perimeter has a plurality of points located a plurality of distinct distances from a central axis 128, 138 of the roller 112, 132, as seen well in FIGS. **12*a*-16; and as will be discussed in detail below. Further, each processing cell 500 need not be of the same design or configuration, for instance some processing cells 500 may incorporate the design illustrated in FIG. 4, while others may incorporate the design illustrated in FIG. 10**, among others.

As previously discussed, the method of the present invention, and particularly the illustrative plating example just disclosed, is so effective that the various treatment solutions S may be surfactant free. For example, the acidic solution 530, the bathing solution 550, the catalyzing solution 570, and the reduction solution 590 of the previously disclosed plating method may be void of surfactants. Additionally, the plating method may further include agitation, and more specifically ultrasonic agitation, represented by agitator 552, of the treatment solution S and yarn Y to further improve the efficiency of the various steps in the plating process. The introduction of ultrasonic agitation in the bathing solution 550, in particular, is extremely effective at ensuring that the amount of residual acidic solution 530 carried over into other steps in the process is minimized, however, ultrasonic agitation may be effectively used in any of the steps of the process.

As one illustration of the improved control offered by the present invention, the processing cell 500 containing the acidic solution 530 intended to etch the individual filaments F of the yarn Y produces filaments F with substantially uniform etching. It is widely understood in the industry that the exposure time of the filaments Y to the acidic solution 530 during etching should be optimized to avoid extensive filament degradation. Traditionally, uniform etching of the individual filaments F has been very difficult to achieve unless the filaments F are separated from each other during immersion in the acidic solution 530. Most prior methods recognize this limitation and opt for reduced contact time to minimize the potential damage to the filaments F. As such, many of the filaments F are inadequately etched and are therefore less susceptible to the catalyst, resulting in filaments F having weak plating-to-fiber adhesion. The present invention's repeated disruption of the individual filaments F of the yarn Y exposes each filament F of the yarn Y to the acidic solution 530.

While the previous description of the plating method identifies a unique yarn transfer system for each processing cell, all of the yarn transfer systems may function as a single yarn transfer system. This method and the ability to control treatment processing time, and the ability to function as a single yarn transfer system, permits the plating method to operate continuously from the first processing cell to the last processing cell. This is a significant advance given that prior multifilament yarn treatment methods have required intermediate collection and storage of the yarn at various points in the treatment process because of the variability in the transfer speed required in various steps. As such, many prior art treatment systems have relied on more expensive treatment solutions to permit the intermediate storage. For example, many prior methods have relied upon boron based electroless nickel, rather than the much less expensive phosphorous based electroless nickel, because of the former's resistance to oxidation. The cost of boron based electroless nickel is approximately five to six times the cost of phosphorous based electroless nickel. The present method is continuous, thereby not requiring intermediate storage, and is therefore relatively unconcerned with oxidation caused by intermediate storage and can use the most cost effective materials, such as phosphorous based electroless nickel.

The present invention is particularly effective in treating multifilament yarns Y that have been found to be difficult to treat using traditional treatment methods. This method facilitates uniform metal deposition on the highly anisotropic structure of uniaxially oriented polymer fibers. In particular, the present treatment method is effective with multifilament yarns Y composed of a plurality of polymeric filaments, and more specifically polyacrylnitrile, aromatic-heterocyclic rigid-rod polymers, such as poly(p-phenylene benzobisoxazole) (PBO), poly(p-phenylene benzobisthiazole) (PBZT), poly(p-phenylene benzobisimidazole (PBI), poly{2,6-diimidazo[4,5-b:4'5'-e]pyridinylene-1,4(2,5-dihydroxy)phenylene} (M5) and ladder polymers.

This continuous process of metal plating of such high-temperature, high-strength polymers with uniform layers of metals such as nickel, copper, and silver in combined electroless and electroplating processes reduces the cost of these yarns such that they are now practical for application in a wide variety of industries. Such metal plated polymers offer outstanding thermal and thermooxidative stability, mechanical flexibility, durability, strength, electrical conductivity, and are light weight. This method increases the feasibility of incorporating such polymers in applications in electromagnetic interference (EMI) shielding, signal and power transmission, aerospace applications including satellite antennas and space tethers, and electronic textiles.

The present method has produced reliable electroless plating at yarn speeds of 10 feet/min in an experimental laboratory setting. The apparatus 50 disclosed below may facilitate a yarn travel speed of 50 feet/min, and it is estimated that in an industrial production environment the present method may facilitate a yarn travel speed up to 400 feet/min.

One embodiment of the apparatus 50 for the treatment of individual filaments F of a multifilament yarn Y, configured to implement the method of the present invention, is illustrated in FIG. 1. The apparatus 50 includes a treatment solution reservoir 200, containing a predetermined amount of liquid treatment solution S, having at least one sidewall 210 and a bottom 260; and a yarn transfer system 100 configured to feed at least one yarn Y through the reservoir 200, having at least one filament orientation disruption assembly 110 configured to guide the yarn Y through a portion of the reservoir 200 and disrupt the orientation of the individual filaments F, thereby exposing previously unexposed surface areas of each individual filament F to the treatment solution S.

In this embodiment, the treatment solution reservoir 200 may be configured simply as a holding tank containing the treatment solution S into which the yarn Y is fed. The at least one filament orientation disruption assembly 110 may be located within the reservoir 200, immersed in the treatment solution, or it may be external to the reservoir 200, or a hybrid thereof, depending on the particular treatment occurring. For example, if the particular application involves an autocatalytic deposition process, also referred to as electroless plating, then placement of the at least one filament orientation disruption assembly 110 exterior to the reservoir 200 is preferred so as to avoid plating of the assembly. This is also true when the particular application involved is electroplating.

Figure 4:
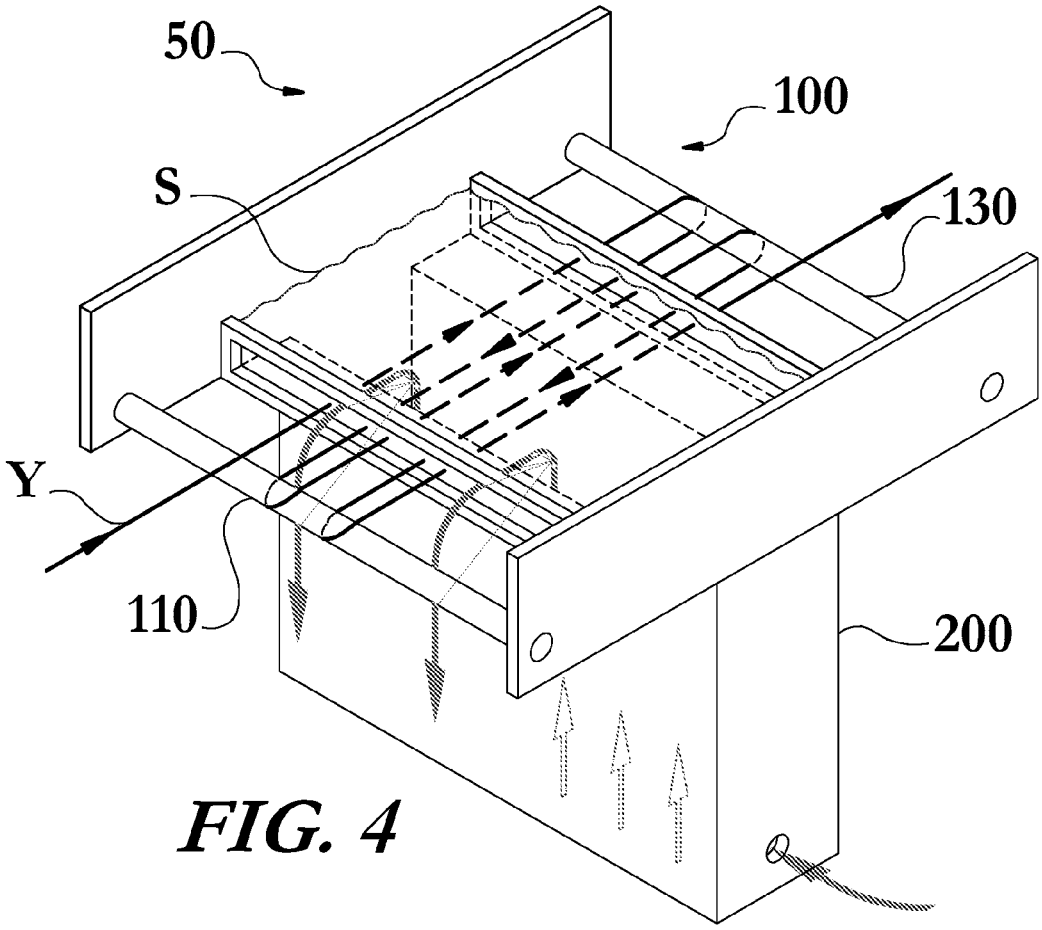
FIG. 4 illustrates an embodiment of the apparatus of the present invention in elevated perspective view, not to scale.

The apparatus 50 may alternatively be configured to minimize the physical space required, as seen in FIG. 4. In this particular embodiment, the at least one sidewall includes an entry sidewall 210 and an exit sidewall 230. The entry sidewall 210 is formed with an entry weir 214 and the exit sidewall 230 is formed with an exit weir 234, best illustrated in FIG. 6 and FIG. 5. In this particular embodiment, the treatment solution S is maintained at a solution level SL above that of the entry weir 214 and the exit weir 234 such that the treatment solution S flows from the reservoir 200 through the entry weir 214 and the exit weir 234, as indicated by the flow arrows FA. Additionally, the entry weir 214 and exit weir 234 are configured such that the yarn Y may repeatedly enter and exit the reservoir 200 through the entry weir 214 and exit weir 234. Each weir 214, 234 has a weir crest 216, 236 and a weir head 218, 238. One with skill in the art will recognize that the configuration of the weir, including the shapes of the weir crests 216, 236 and weir heads 218, 238 may be arranged to achieve certain desired characteristics of the flow from the weirs 214, 234. For example, the weirs 214, 234 may be configured to obtain a constant coefficient of discharge, a linear relationship between head and flow, and a number of characteristics of the nappe, such as whether it is aerated or not.

Figure 10:
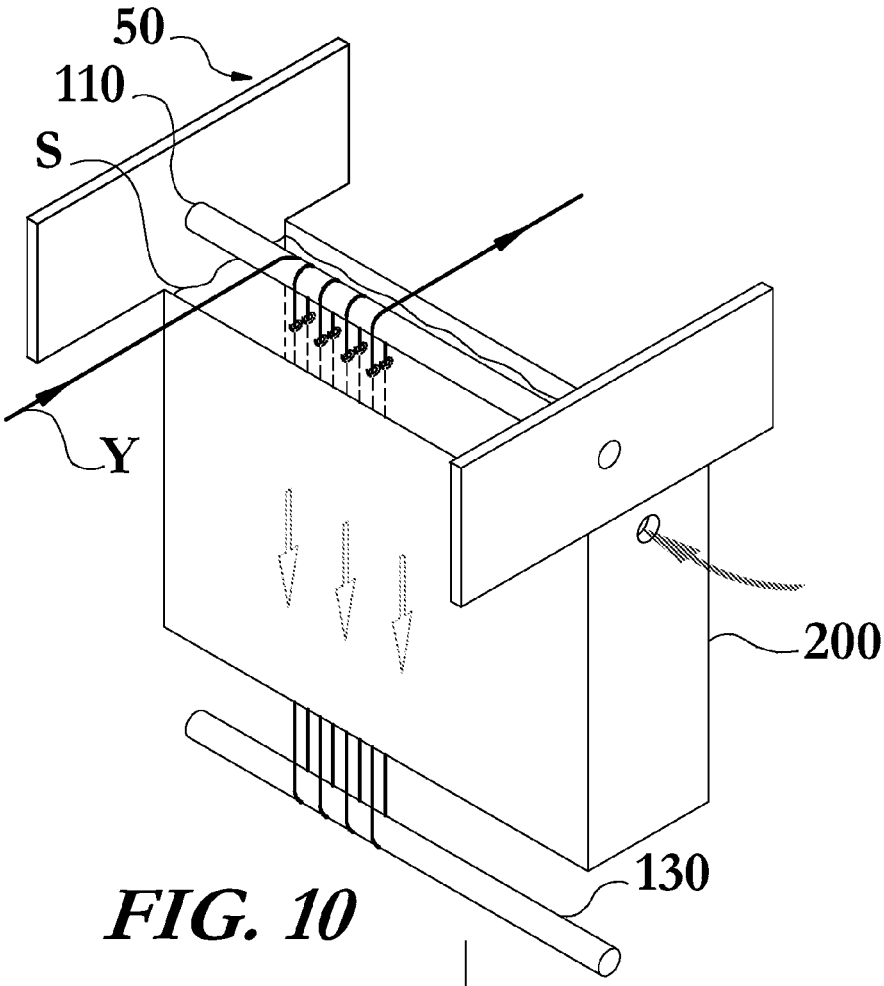
FIG. 10 illustrates an embodiment of the apparatus of the present invention in elevated perspective view, not to scale.

The apparatus 50 may be similarly configured to FIG. 4, but incorporating vertical transfer of the yarn Y, as seen in FIG. 10. In this particular embodiment, the bottom 260 is formed with at least one yarn slot 262, illustrated in FIG. 11. In this particular embodiment, the treatment solution S is maintained at a solution level SL and continuously flows from the reservoir 200 through the at least one yarn slot 262. Additionally, the at least one yarn slot 262 is configured such that the yarn Y may repeatedly enter and exit the reservoir 200 through the at least one yarn slot 262. One with skill in the art will recognize that the configuration of the at least one yarn slot 262 may be designed to achieve certain desired characteristics of the flow from the at least one yarn slot 262. For example, the at least one yarn slot 262 may be configured to obtain a constant coefficient of discharge, a linear relationship between head and flow, and a number of characteristics of the nappe, such as whether it is aerated or not.

In these embodiments, the at least one filament orientation disruption assembly may include a first filament orientation disruption assembly 110 and a second filament orientation disruption assembly 130 between which the yarn Y may repeatedly traverse. While the following description is focused on the embodiment illustrated in FIG. 4 and FIG. 5, it equally applies to the embodiment illustrated in FIG. 10 and FIG. 11 incorporating the at least one yarn slot 262. The first filament orientation disruption assembly 110 may include a first roller 112, located external to the reservoir 200 and in close proximity to the entry weir 214, and the second filament orientation disruption 130 assembly may include a second roller 132, located external to the reservoir 200 and in close proximity to the exit weir 234. The first roller 112 and the second roller 132 may be configured to rotate as the yarn Y turns about the first roller 112 and the second roller 132, and to guide the yarn Y through the entry weir 214, the reservoir 200, and the exit weir 234 while disrupting the orientation of the individual filaments F, thereby exposing previously unexposed surface areas of each individual filament Y to the treatment solution S. The present invention also provides great benefits in the field of electroplating. The repeated traverses of the yarn Y between the first filament orientation disruption assembly 110 and a second filament orientation disruption assembly 130 facilitates the application of greater current density to the yarn Y. Conventional single pass electroplating systems are generally limited to the application of approximately ⅛ amp current to the entire length of yarn Y in the electroplating bath. The present invention facilitates the introduction of current at each traverse between the filament disruption orientation assemblies 110, 130. Experiments have demonstrated a current of up to 20 amps between the first filament orientation disruption assembly 110 and a second filament orientation disruption assembly 130. Additionally, locating the first filament orientation disruption assembly 110 and the second filament orientation disruption assembly 130 external to the treatment solution greatly reduces the likelihood of contamination.

Figure 8:
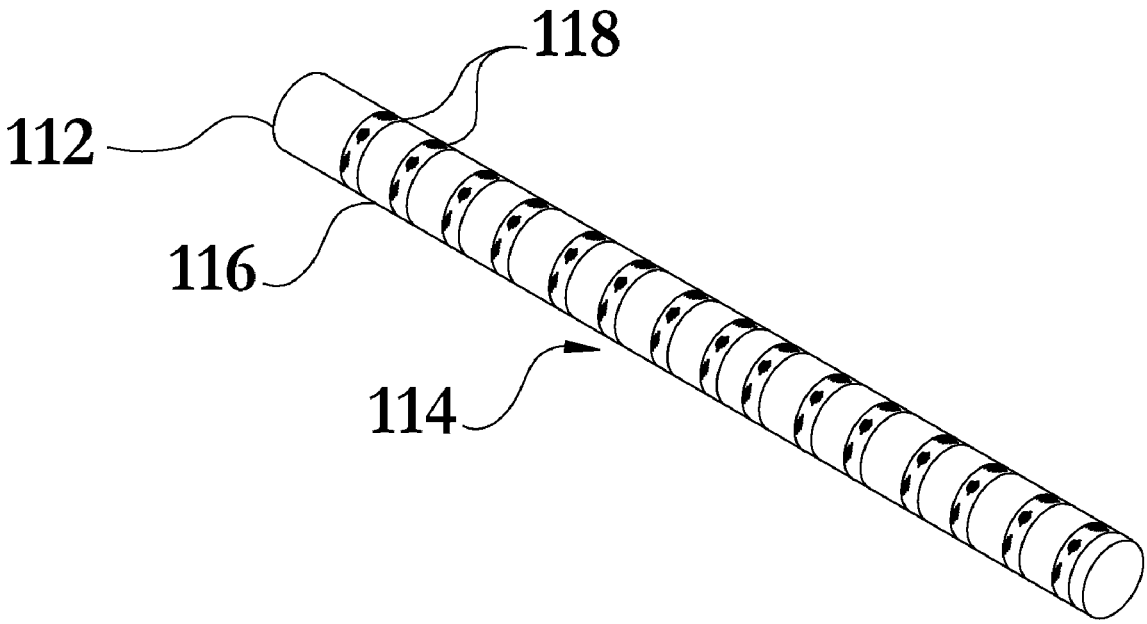
FIG. 8 illustrates an embodiment of a filament orientation disruption assembly of the present invention.
Figure 9:
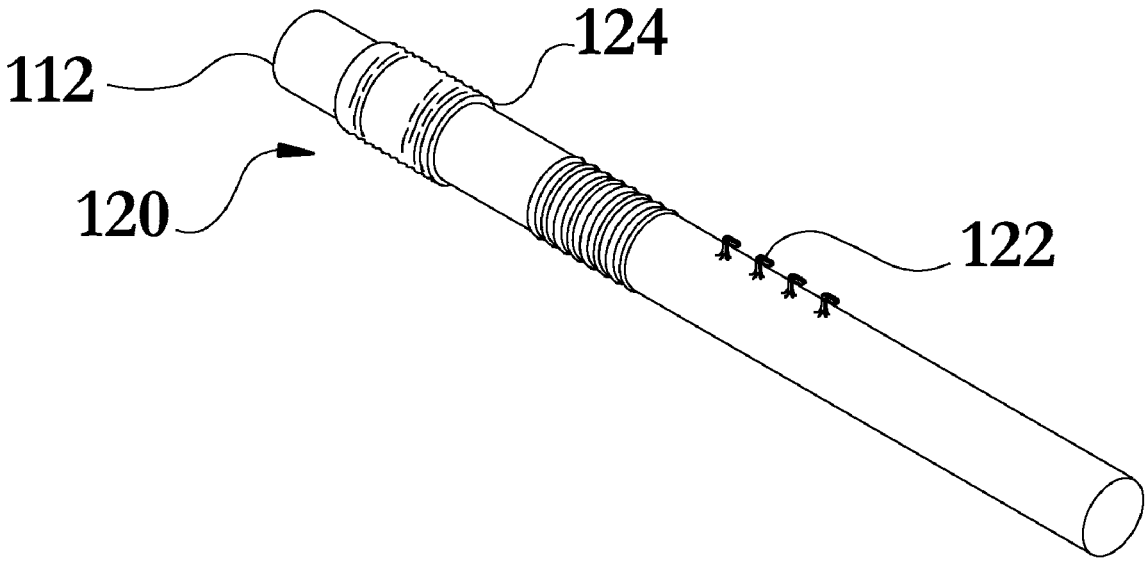
FIG. 9 illustrates an embodiment of a filament orientation disruption assembly of the present invention.

While this particular embodiment illustrates the at least one filament orientation disruption assembly 110 as a number of rollers 112, 132, one with skill in the art will appreciate that the at least one filament orientation disruption assembly 110 may incorporate any number of material handling assemblies that would disrupt the orientation of the individual filaments F. As previously disclosed, the rollers 112, 132 by themselves will impart disruption of the filaments F, however, a number of disruption increasing variations may be incorporated with the rollers 112, 132. For example, the rollers 112, 132 may incorporate a number of roller surface variations 114 and roller contour variations 120 designed to increase the disruption in the orientation of the filaments F, as illustrated in FIG. 8 and FIG. 9. Such surface variations 114 and contour variations 120 may be specifically designed to introduce substantially controlled orientation disruptions or purely random orientation disruptions.

In one particular embodiment, it may be desirable that the at least one filament orientation disruption assembly 110 further include at least one roller 112, 132 having a roller profile such that for a given transverse section of the roller 112, 132, a roller surface perimeter has a plurality of points located a plurality of distinct distances from a central axis 128, 138 of the roller 112, 132, as seen well in FIGS. 12*a*-16.

Figure 12A:
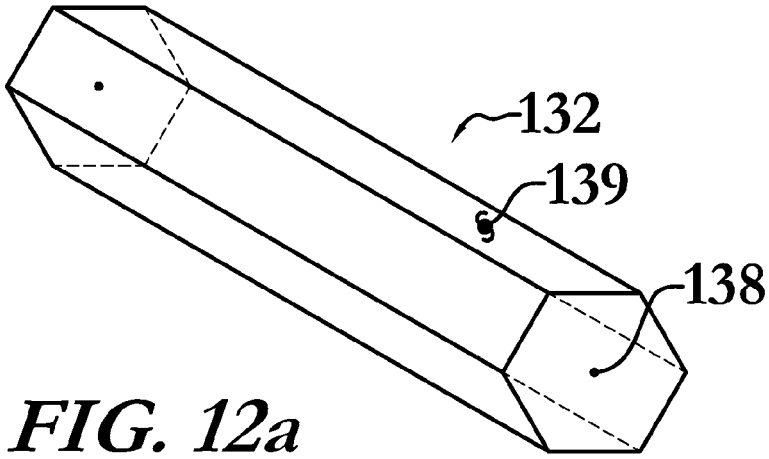
FIG. 12*a* illustrates an elevated perspective view of a portion of an embodiment of the present invention, not to scale.
Figure 12B:
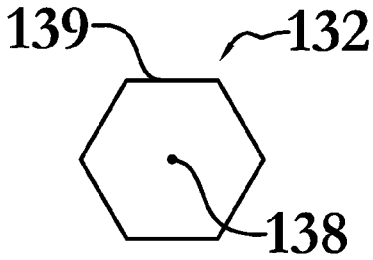
FIG. 12*b* illustrates a cross-sectional view of a portion of an embodiment of the present invention, not to scale.
Figure 13A:
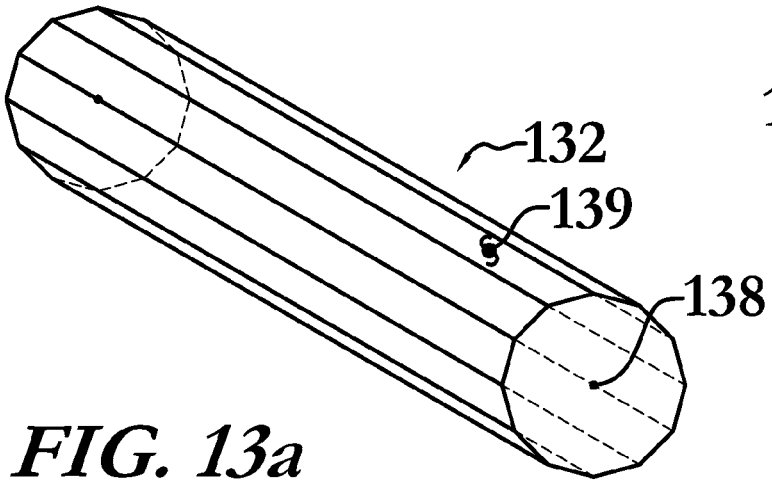
FIG. 13*a* illustrates an elevated perspective view of a portion of an embodiment of the present invention, not to scale.
Figure 13B:
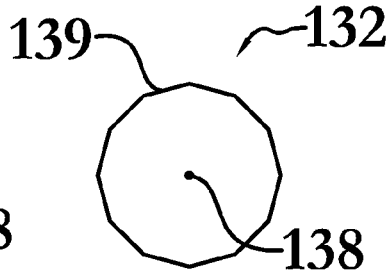
FIG. 13*b* illustrates a cross-sectional view of a portion of an embodiment of the present invention, not to scale.
Figure 14A:
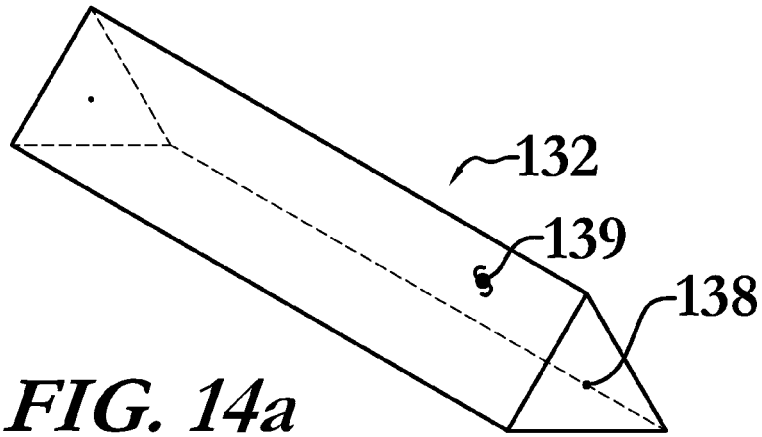
FIG. 14*a* illustrates an elevated perspective view of a portion of an embodiment of the present invention, not to scale.
Figure 14B:
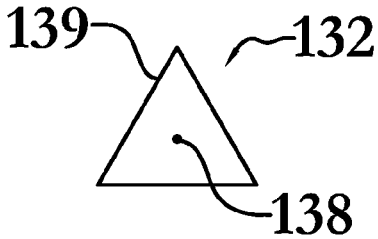
FIG. 14*b* illustrates a cross-sectional view of a portion of an embodiment of the present invention, not to scale.

In FIGS. 12*a*-*b*, a second roller 132 is seen having a hexagonal cross-section, in FIGS. 13*a*-*b* a second roller 132 is seen having a twelve-sided cross-section, and in FIGS. 14*a*-*b* a second roller 132 is seen having a triangular cross-section. Each of these three embodiments is shown having a different plurality of second roller faces 139. The effect of utilizing at least one roller 112, 132 having a roller profile such that for a given transverse section of the roller 112, 132, a roller surface perimeter has a plurality of points located a plurality of distinct distances from a central axis 128 of the roller 112, 132 is demonstrated in FIGS. 15-16.

One skilled in the art will realize that as a roller 132 so-configured as in FIGS. 12*a*-16 turns, the path of a yarn Y passed around the roller 132 is shortened or lengthened as the path of the yarn changes. One skilled in the art will also realize that this effect is least pronounced when roller 132 is close to being cylindrical in shape, and most pronounced when a rollers is least close to being cylindrical in shape. Accordingly, a triangular roller is pictured in FIGS. 15 and 16 to illustrate this change in yarn path length most clearly.

Figures 15, 16:
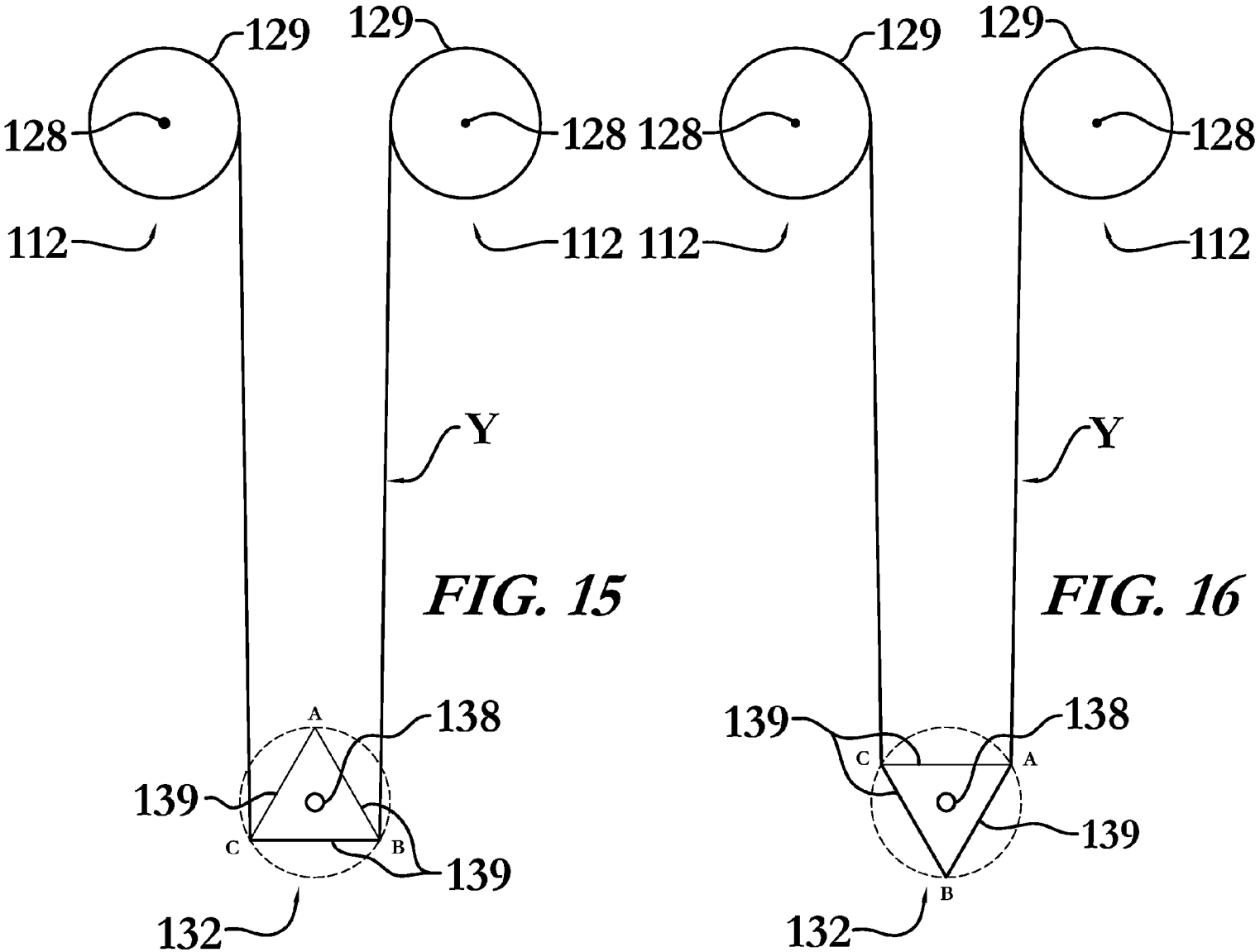
FIG. 15 illustrates a side view of a portion of an embodiment of the present invention, not to scale.
FIG. 16 illustrates a side view of a portion of the portion of the embodiment of FIG. 15, in a changed operable position, not to scale These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

It may be seen in FIGS. 15-16 that first roller 112, cylindrical in cross-section, has a roller surface 129 and a roller perimeter formed by the cylindrically shaped roller surface 129 extending around the roller 112. Thus, as yarn Y is passed around roller 112, no change in yarn path length occurs as the roller 112 turns about a first roller axis 128.

However, second roller 132, shown in FIGS. 15-16, is configured with three roller surfaces 139 that form a roller perimeter formed as the sum of sides AB, BC, and CA. As the second roller 132 turns, the yarn path changes in length. Such a change in yarn path length causes an increase and decrease in the tension on the yarn Y, and such tension changes induce a filament orientation disruption.

One skilled in the art will also realize that path length is further affected by the size of the roller, that is, a large non-circular roller will affect yarn path length more than a small non-circular roller of the same configuration. Furthermore, one skilled in the art will realize that while in FIGS. 12*a*-16, second rollers 132 having flat sides are pictured for the sake of illustration only, the principles remain the same for any roller, not limited to either a first roller 112 or a second roller 132, in which the at least one roller 112, 132 has a roller profile such that for a given transverse section of the roller 112, 132, a roller surface perimeter has a plurality of points located a plurality of distinct non-equal distances from a central axis 128 of the roller 112, 132, e.g., a roller 112, 132 having an oval or otherwise non-cylindrical cross section would also be effective.

The variation in yarn path length provides an alternating stretch and relaxation of the yarn, which as discussed above can be regulated by regulating the configuration and size of the roller 112, 132, to assist with the filament orientation disruption. The alternating stretch and relaxation provides a frequently changing dynamic tension in the multifilament yarn, which tends to alternately open and close the space between the intertwined filaments, and this opening and closing action facilitates thorough ingress of all treatment solutions into the yarn.

One with skill in the art will appreciate that such surface variations 114 and contour variations 120 may further improve the present invention's ability to treat numerous yarns at the same time.

One variation of a roller surface variation is illustrated in FIG. 8. This variation illustrates a roller 112 having alternating non-gripping 116 and gripping 118 sections. The non-gripping sections 116 may simply be low friction areas on the roller 112 while the gripping sections 118 may incorporate virtually any surface treatment that increases the roughness of the section. Alternatively, FIG. 9 illustrates a roller 112 having at least one roller contour variation 120. In one embodiment the at least one roller contour variation 120 is configured as a roller glove 124 that may be applied to the roller 112. The roller glove 124 may be made of any number of materials that can control the movement of the filaments, including, but not limited to, latex. The glove 124 may also serve to shield the roller 112 from the treatment solution S. A portion of the roller 112 may incorporate a plurality of yarn fingers 122 formed to guide the yarn Y as it passes and imparts unique filament orientation disruptions.

Figure 5:
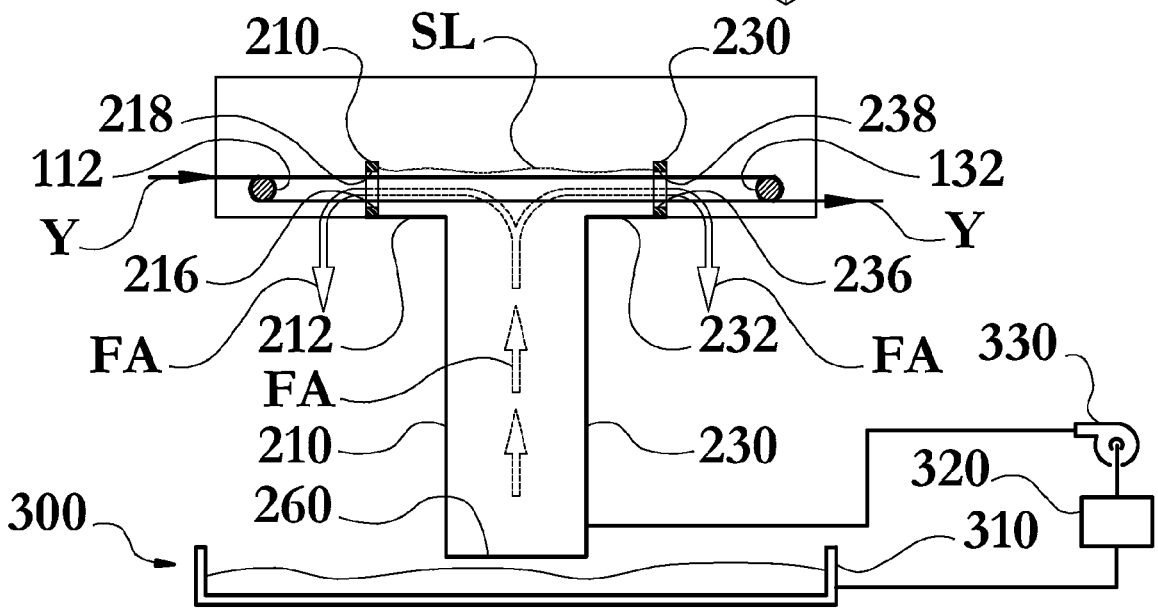
FIG. 5 illustrates an embodiment of the apparatus of the present invention in part in cross sectional view and in part schematically, not to scale.
Figure 11:
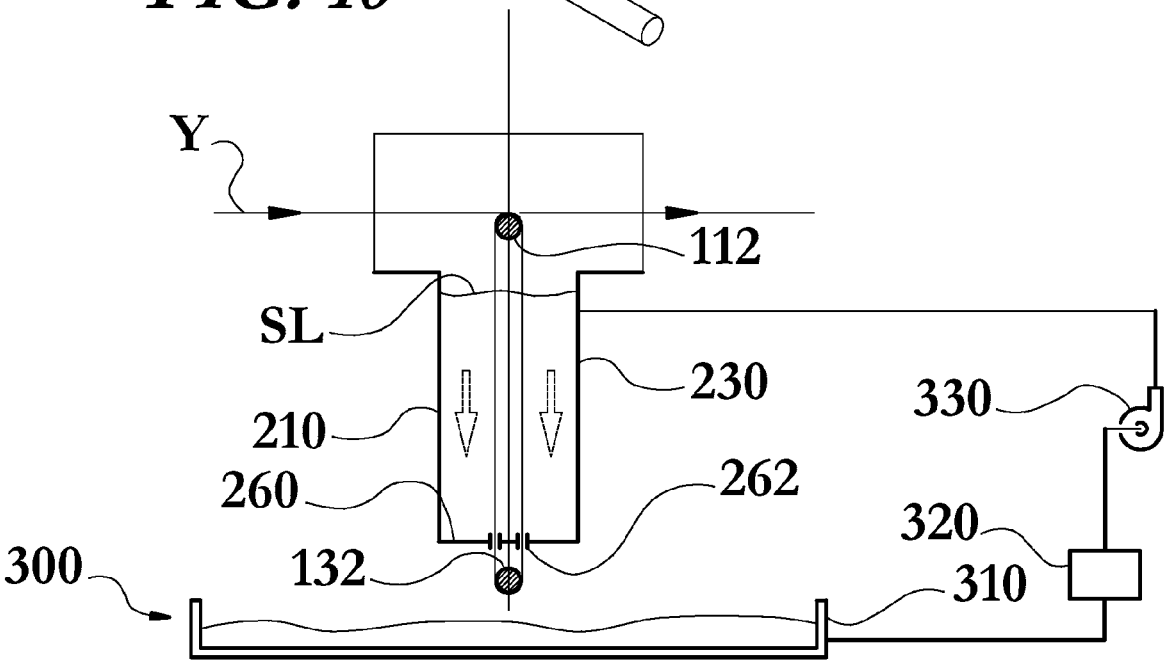
FIG. 11 illustrates the apparatus of the present invention in part in cross sectional view and in part schematically, not to scale.

Referring now to FIG. 5 and FIG. 11, the apparatus 50 may further include a collection and filtration system 300 having a collection basin 310, configured to collect the treatment solution S as it exits the entry weir 214 and the exit weir 234, or the at least one yarn slot 262, a filtration assembly 320 to filter the treatment solution S collected in the collection basin 310, and a pump 330 to transfer the filtered treatment solution S back into the treatment solution reservoir 200. The filtered treatment solution S may enter the treatment solution reservoir 200 at such locations, and in such a fashion, as to impart desirable flow patterns in the treatment solution reservoir 200. Such desirable flow patterns may reduce the likelihood of contamination in the treatment solution S. For example, the filtered treatment solution S may enter the treatment solution reservoir 200 through a centrally located feed port 270, illustrated in FIG. 6, near the bottom of the reservoir 200, so as to cause a bottom-to-top and center-to-sides flow pattern in the treatment solution, best illustrated in FIG. 5 by flow arrows FA. Alternatively, the treatment solution S may enter the treatment reservoir 200 through a centrally located feed port 270 near the top of the reservoir 200, as seen in FIG. 10 and FIG. 11, to produce top to bottom flow. Similarly, the treatment solution S may enter the treatment reservoir 200 through a variety of orifice plates, not shown, designed specifically for the desired treatment. For instance, if agitation is desired the filtered treatment solution S may enter the solution reservoir 200 through an orifice plate that will result in the desired agitation. Alternatively, the filtered treatment solution S may enter the solution reservoir 200 in a series of predetermined pulses, possibly entrained with air, or other gases.

An experimental version of the apparatus 50 has successfully utilized a solution reservoir 200 containing approximately 2 liters of treatment solution S. This version provides approximately 38 turnovers per minute of the solution in the reservoir 200, with the solution S being continuously filtered. Prior art treatment tanks have generally been limited to far fewer turnovers per minute due to the high likelihood of yarn entanglement from the increased flow rates in the reservoir.

Figure 6:
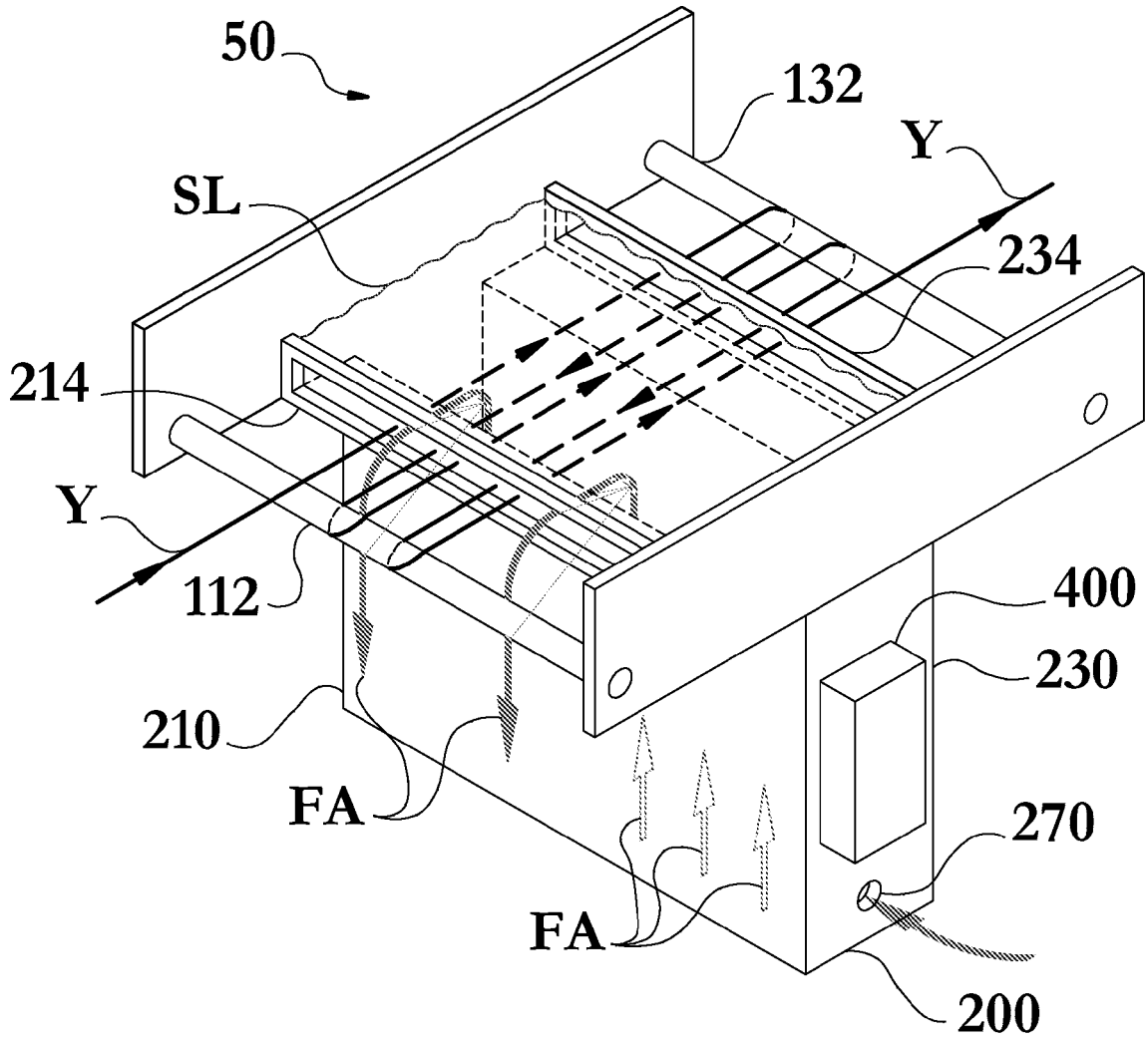
FIG. 6 illustrates an embodiment of the apparatus of the present invention in elevated perspective view, not to scale

The apparatus 50 may further include an ultrasonic agitation system 400, as seen in FIG. 6. The agitation system is in operative communication with the treatment solution reservoir 200 and agitates the yarn Y and the treatment solution S, further increasing the orientation disruption of the individual filaments F and increasing the exposure of substantially all of the surface area of each individual filament F to the treatment solution S. One with skill in the art will appreciate that the agitation may be introduced in any number of ways including, but not limited to, mechanically, chemically, electromechanically, acoustically, and electromagnetically.

Additional variations, not illustrated, may incorporate a tensioning system so that the tension on the yarn can be controlled.

What is claimed then, in a series of embodiments, is a method for treating a plurality of surfaces of individual filaments in a multifilament yarn. In one embodiment, meant for illustration only, the method may include immersing a multifilament yarn having a plurality of individual filaments into at least one liquid treatment solution and coating a plurality of exposed surface areas of the individual filaments with the treatment solution.

To assist with the coating, a further step may include creating an orientation disruption of the plurality of individual filaments by passing the multifilament yarn around at least one roller having a roller profile such that for a given transverse section of the roller, a roller surface perimeter has a plurality of points located a plurality of distinct distances from a central axis of the roller. While such a roller may have a plurality of flat sides, it is not intended that this embodiment be limited to such; any roller satisfying the above definition may be useful.

The method may continue with withdrawing the multifilament yarn from the at least one treatment solution; and repeating the immersion and orientation disruption steps detailed above until a predetermined coating level is achieved. One skilled in the art will realize that no particular number of repetitions is intended or required.

In another embodiment, the method may include the step of agitating the multifilament yarn and the at least one treatment solution to further increase the orientation disruption of the plurality of individual filaments and increase an amount of coated surface area.

In yet another embodiment, another method of treating the surfaces of individual filaments in a multifilament yarn may include the following steps, among others. The embodiment includes providing a plurality of processing cells, wherein each processing cell has a treatment solution reservoir containing a predetermined amount of a predetermined treatment solution. Utilizing these treatment cells, an intended user could feed a multifilament yarn having a plurality of individual filaments having external surfaces into a first yarn transfer system that guides the ingress and egress of the multifilament yarn to and from a first treatment cell having at least a first roller. This first treatment cell could contain at least a first treatment solution comprising an acidic solution that substantially uniformly etches the exterior surfaces of the plurality of individual filaments.

Later, the user could transfer the multifilament yarn from the first yarn transfer system to a second yarn transfer system that guides the ingress and egress of the multifilament yarn to and from a second treatment cell having at least a second roller. This second treatment cell could contain at least a second treatment solution comprising an ultrasonic water bath that creates substantially clean and wet exterior surfaces of the plurality of individual filaments.

In a later step, the user could transfer the multifilament yarn from the second yarn transfer system to a third yarn transfer system that guides the ingress and egress of the yarn to and from a third treatment cell having at least a third roller. This third treatment cell could contain at least a third treatment solution comprising a catalyzing solution that creates a substantially uniform absorption of a plurality of metal ions on the plurality of individual filaments.

In a still later step, the user could transfer the multifilament yarn from the third yarn transfer system to a fourth yarn transfer system that guides the ingress and egress of the yarn to and from a fourth treatment cell having at least a fourth roller. This fourth treatment cell could contain at least a fourth treatment solution comprising a reduction solution that creates a substantially uniform in-situ reduction of a plurality of metal ions on the plurality of individual filaments.

At a subsequent point, the user could transfer the multifilament yarn from the fourth yarn transfer system to a fifth yarn transfer system that guides the ingress and egress of the yarn to and from a fifth treatment cell having at least a fifth roller. This fifth treatment cell could contain at least a fifth treatment solution comprising an electroless bath that creates a substantially uniform conductive undercoating on the plurality of individual filaments.

Additional steps using additional treatment solutions and methods will be easily seen by one skilled in the art. In one particular embodiment, the method may include a step of electroplating the multifilament yarn.

In various embodiments, at least one of the rollers selected from the group of rollers including the first, second, third, fourth, and fifth rollers may further include a roller profile such that for a given transverse section of the roller, a roller surface perimeter has a plurality of points located a plurality of distinct distances from a central axis of the roller. As previously discussed, no particular geometry other than that which satisfies the definition above is intended or required. There may be one, two, or many such-configured rollers used in different embodiments.

Additionally, in some related embodiments, there may be at least one roller selected from the group of rollers including the first, second, third, fourth, and fifth rollers that further include a surface varied roller having alternating non-gripping and gripping sections, a roller glove, or a plurality of yarn fingers, among other variations.

In a related embodiment, a step may be included of agitating the multifilament yarn and at least one of the treatment solutions selected from the group of treatment solutions including the acidic solution, the catalyzing solution, the reduction solution, and the electroless bath to create an orientation disruption of the individual filaments. This step may, but is not required to, include ultrasonic agitation.

A plurality of materials may be included in each of the treatment solutions, and none of the exemplary embodiments discussed herein is intended to limit in any manner the choices appropriately made by one skilled in the art. By way of example, the catalyzing solution may include a palladium salt solution creating a substantially uniform absorption of a plurality of palladium ions on a plurality of the individual filaments of the multifilament yarn. Application of such a palladium salt solution may be followed at some point by immersion in a reduction solution further comprising an alkaline sodium borohydride solution. Such a sodium borohydride solution could reduce a plurality of the absorbed palladium ions to form a substantially uniform coating of palladium metal on a plurality of the individual filaments of the multifilament yarn.

Many types of multifilament yarns are suitable for use in the claimed method, again as would be understood by one skilled in the art. These can include yarns having a plurality of polymeric filaments, a plurality of inorganic filaments, and/or a plurality of metallic filaments. In more detailed embodiments, polymeric filaments in suitable yarns may include polyolefin, polyacrylnitrile, oxidized polyacrylnitrile, polyester, polyvinyl alcohol, polyamide, polyphenylene sulfide, polyimide, aramid, polybenzimidazoles, fluorinated fibers, aromatic-heterocyclic rigid-rod polymers, ladder polymers, carbon fiber, and graphite fiber. Refining the concept somewhat more, a yarn that includes aromatic-heterocyclic rigid-rod polymers may further include poly(p-phenylene benzobisoxazole) (PBO), polyp-phenylene benzobisthiazole) (PBZT), poly(p-phenylene benzobisimidazole (PBI), and poly{2,6-diimidazo[4,5-b:4'5'-e]pyridinylene-1,4(2,5-dihydroxy)phenylene} (M5).

In another embodiment, a method for the treatment of individual fibers of a multifilament yarn may include the following steps. An intended user could pass a multifilament yarn through at least one treatment solution reservoir having a bottom, a top, and at least one sidewall. This at least one treatment solution reservoir could contain a predetermined amount of at least one predetermined treatment solution.

Simultaneously with passing the yarn through the at least one treatment solution reservoir, the user could pass the multifilament yarn across a yarn transfer system including at least one roller having a roller profile such that for a given transverse section of the roller, a roller surface perimeter has a plurality of points located a plurality of distinct distances from a central axis of the roller. As previously discussed, no particular geometry other than that which satisfies this description is intended or required.

Within the treatment solution in the treatment solution reservoir, the method may be enhanced by creating a fluid flow pattern within the at least one predetermined treatment solution including a flow pattern from bottom-to-top and center-to-sides of the treatment reservoir. Circulation of the treatment solution may also be enhanced by passing the multifilament yarn through the at least one treatment solution reservoir while also passing the multifilament yarn through at least one yarn slot in the at least one sidewall. This allows the at least one yarn slot to further allow a continuous egress of the at least one predetermined treatment solution from the at least one treatment reservoir. The predetermined treatment solution may then be cleaned, added to, or otherwise further processed, if required, and then replaced into the treatment solution reservoir.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A continuous method of treating the surfaces of individual filaments in a multifilament yarn, the method comprising:

(a) providing a plurality of processing cells, wherein each processing cell has a treatment solution reservoir containing a predetermined amount of a predetermined treatment solution;

(b) feeding a multifilament yarn having a plurality of individual filaments having external surfaces into a first yarn transfer system that guides the ingress and egress of the multifilament yarn to and from a first treatment cell having at least a first roller, wherein the first treatment cell contains at least a first treatment solution comprising an acidic solution that substantially uniformly etches the exterior surfaces of the plurality of individual filaments;

(c) transferring the multifilament yarn from the first yarn transfer system to a second yarn transfer system that guides the ingress and egress of the multifilament yarn to and from a second treatment cell having at least a second roller, wherein the second treatment cell contains at least a second treatment solution comprising an ultrasonic water bath that creates substantially clean and wet exterior surfaces of the plurality of individual filaments;

(d) transferring the multifilament yarn from the second yarn transfer system to a third yarn transfer system that guides the ingress and egress of the yarn to and from a third treatment cell having at least a third roller, wherein the third treatment cell contains at least a third treatment solution comprising a catalyzing solution that creates a substantially uniform absorption of a plurality of metal ions on the plurality of individual filaments;

(e) transferring the multifilament yarn from the third yarn transfer system to a fourth yarn transfer system that guides the ingress and egress of the yarn to and from a fourth treatment cell having at least a fourth roller, wherein the fourth treatment cell contains at least a fourth treatment solution comprising a reduction solution that creates a substantially uniform in-situ reduction of a plurality of metal ions on the plurality of individual filaments; and (f) transferring the multifilament yarn from the fourth yarn transfer system to a fifth yarn transfer system that guides the ingress and egress of the yarn to and from a fifth treatment cell having at least a fifth roller, wherein the fifth treatment cell contains at least a fifth treatment solution comprising an electroless bath that creates a substantially uniform conductive undercoating on the plurality of individual filaments;

wherein at least one of the rollers selected from the group of rollers consisting of the first, second, third, fourth, and fifth rollers is configured to cause orientation disruption of the plurality of individual filaments such that they translate with respect to one another, rotate with respect to one another, or a combination thereof;

wherein the at least one roller further comprises a profile such that for a given transverse section of the roller, a roller surface perimeter has a plurality of points located a plurality of distinct distances from a central axis of the roller.

2. The method of claim 1, wherein at least one roller selected from the group of rollers consisting of the first, second, third, fourth, and fifth rollers further comprises a surface varied roller having alternating non-gripping and gripping sections.

3. The method of claim 1, wherein at least one roller selected from the group of rollers consisting of the first, second, third, fourth, and fifth rollers further comprises a roller having at least one roller glove.

4. The method of claim 1, wherein at least one roller selected from the group of rollers consisting of the first, second, third, fourth, and fifth rollers further comprises a roller having a plurality of yarn fingers.

5. The method of claim 1, further comprising the step of agitating the multifilament yarn and at least one of the treatment solutions selected from the group of treatment solutions consisting of the acidic solution, the catalyzing solution, the reduction solution, and the electroless bath to create an orientation disruption of the individual filaments.

6. The method of claim 5, wherein the agitation is introduced ultrasonically.

7. The method of claim 1, wherein the catalyzing solution further comprises a palladium salt solution creating a substantially uniform absorption of a plurality of palladium ions on a plurality of the individual filaments of the multifilament yarn.

8. The method of to claim 7, wherein the absorbed palladium ions are reduced by immersion in a reduction solution further comprising an alkaline sodium borohydride solution that reduces a plurality of the absorbed palladium ions to form a substantially uniform coating of palladium metal on a plurality of the individual filaments of the multifilament yarn.

9. The method of claim 1, wherein the multifilament yarn further comprises a plurality of polymeric filaments.

10. The method of claim 1, wherein the multifilament yarn further comprises a plurality of inorganic filaments.

11. The method of claim 1, wherein the multifilament yarn further comprises a plurality of metallic filaments.

12. The method of claim 9, wherein the plurality of polymeric filaments is selected from the group consisting of polyolefin, polyacrylnitrile, oxidized polyacrylnitrile, polyester, polyvinyl alcohol, polyamide, polyphenylene sulfide, polyimide, aramid, polybenzimidazoles, fluorinated fibers, aromatic-heterocyclic rigid-rod polymers, ladder polymers, carbon fiber, and graphite fiber.

13. The method of claim 12, wherein the aromatic-heterocyclic rigid-rod polymer is selected from the group consisting of poly(p-phenylene benzobisoxazole) (PBO), poly(p-phenylene benzobisthiazole) (PBZT), poly(p-phenylene benzobisimidazole (PBI), and poly{2,6-diimidazo[4,5-b:4'5'-e]pyridinylene-1,4(2,5-dihydroxy)phenylene} (M5).

14. The method of claim 12, wherein the aromatic-heterocyclic rigid-rod polymer further comprises poly(p-phenylene benzobisoxazole) (PBO).

15. The method of claim 1, further comprising a step of electroplating the multifilament yarn.

* * * * *